United States Patent [19]

Martin

[11] 3,983,664

[45] Oct. 5, 1976

[54] BELT-TYPE SANDER ATTACHMENT FOR PORTABLE POWER DRILLS

[76] Inventor: Ronald Martin, 5225 SW. Lakeview Blvd., Lake Oswego, Oreg. 97034

[22] Filed: Nov. 21, 1975

[21] Appl. No.: 634,192

[52] U.S. Cl. ..... 51/170 EB
[51] Int. Cl.[2] ..... B24B 23/00
[58] Field of Search ..... 51/170 EB

[56] References Cited

UNITED STATES PATENTS

| | | | |
|---|---|---|---|
| 1,227,047 | 5/1917 | Gray | 51/170 EB |
| 2,044,982 | 6/1936 | Hedgpeth | 51/170 EB |
| 2,483,720 | 10/1949 | Asbury | 51/170 EB |
| 2,538,044 | 1/1951 | Ruehle | 51/170 EB |
| 2,819,565 | 1/1958 | Werth | 51/170 EB |

*Primary Examiner*—James L. Jones, Jr.
*Attorney, Agent, or Firm*—Chernoff & Vilhauer

[57] ABSTRACT

A portable belt-type sanding device adapted for use as an accessorial attachment to a portable hand-held power drill. The sander comprises a pair of laterally spaced rollers rotatably mounted within an open-bottomed elongate body member with a bearing plate interposed between the rollers and attached to the body member to provide a firm backing for the operative portion of a sanding belt looped around the two rollers. Provision is made for coupling the power drill directly to a drive axle of one of the two rollers, and the driven roller and its drive axle are offset from the plane of the bearing plate a perpendicular distance sufficient to prevent the coupled drill body from contacting a work piece against which the bearing plate is pressed as the sander is being operated. A handle adjustably attached to the top of the body member may be positioned on either side of a line through the longitudinal center of the body member to facilitate grasping the sander with either hand while holding the handle of the power drill in a manner permitting manipulation of its on/off switch with the other hand. The bearing plate providing the supportive backing for the operative portion of the sanding belt is of sufficiently small size to permit the sander to be powered by a relatively low-power drill without danger of overloading the drill motor. Provision is also included for selectively mounting the sander on a work table with the plane of its bearing plate oriented either vertically or horizontally.

6 Claims, 8 Drawing Figures

BELT-TYPE SANDER ATTACHMENT FOR PORTABLE POWER DRILLS

BACKGROUND OF THE INVENTION

The present invention is related to accessorial belt-type sanding attachments for hand-held portable power drills. Examples of such sanding devices previously known to the art are exemplified by Asbury U.S. Pat. No. 2,483,720, Ruehle U.S. Pat. No. 2,538,044 and Werth U.S. Pat. No. 2,819,565.

Among the principal disadvantages of the known prior art devices are: (1) their inability to operate over relatively large planar surfaces while preventing the motor housing portion of the drill body from contacting the work piece without requiring that the hand-held drill be coupled to the sander indirectly via an intermediate system of pulleys, gears or other couplings; (2) a lack of provision for coupling the hand-held power drill directly to either side of the sander and permitting the operator to grasp the sander from a respective opposite side in a balanced fashion such that the sander and drill combination may be operated conveniently by either a right- or left-handed operator holding the sander in one hand and the drill in the other with the weight of the two devices distributed substantially equally between the two hands; (3) the use of a relatively large-area bearing plate positioned between the two belt-supporting rollers as backing support for the operative portion of the sanding belt, with the result that the drill motor driving the sander is easily overloaded as the sander is pressed against a work piece; and (4) a lack of provision for selectively mounting the sander and drill combination to a work table with the operative portion of the sanding belt oriented in either a horizontal or vertical position.

SUMMARY OF THE INVENTION

The present invention is directed to an accessorial belt-type sander attachment adapted to be driven directly by a portable hand-held power drill and operated conveniently by either a right- or left-handed operator to sand a relatively large planar surface. More particularly, the sander attachment of the present invention comprises an elongate open-bottomed body member housing a pair of laterally spaced substantially cylindrical rollers about which is looped an endless sanding belt. A relatively small-area bearing plate is located between the two rollers, extending substantially less than the lateral distance between the rollers, so as to be positioned within the loop formed by the sanding belt to provide a backing surface for the operative portion of the belt. A drive shaft attached to one of the rollers and extendable from either side of the body of the sander is provided to enable the direct coupling of a portable hand-held power drill to either the right or left side of the sander by reversing the roller and drive shaft combination 180° within the body member and engaging the extending portion of the shaft with the chuck of the drill. The driven roller and its related drive shaft are perpendicularly offset from the bearing plate surface a distance sufficient to prevent the motor housing portion of the body of the power drill, when coupled to the sander, from contacting a planar work piece over which the sander is moved. The bearing plate itself is of a limited size, extending substantially less than the lateral distance between the two rollers, so as to prevent the shearing forces generated as the sander attachment is pressed against a work piece from having a magnitude sufficient to overload the motor of the drill, thereby permitting the sanding belt to be powered at a high linear rate of speed by a relatively low-power drill. A pair of skids at either end of the body member are provided to prevent any gouging of the work piece which might otherwise result from the limited size of the bearing plate.

A grip knob is adjustably attachable to the top of the body member at alternative locations on either side of an imaginary line through the longitudinal center of the body member bisecting the rollers, so as to facilitate control of the sander by the operator. In use, the knob is positioned on the side of the center line opposite the drill, thereby permitting the operator to control the sander with one hand and hold the drill with the other while the weight of the sander and drill combination is distributed substantially equally between the two hands and the dynamic forces produced by the sander and drill are resisted in a balanced fashion. Permitting the drill to be attached to either side of the sander, and the knob to be positioned on the respective opposite side of the top of the body member, permits the sander and drill combination to be used by either a right- or left-handed person by simply repositioning the knob and drill to the respective opposite sides of the sander.

Provision is also included for mounting the sander attachment to a work table with the operative portion of the sanding belt oriented in either an upwardly facing horizontal position or in a vertical position. This feature permits the sander attachment and its associated power drill to be utilized as a conventional bench-mounted sander and significantly increases the versatility of the device. For this application an adjustable guide is provided for helping to position the work piece.

It is, therefore, a principal objective of the present invention to provide a belt-type sander attachment, the drive roller of which has a drive shaft axle capable of being coupled directly to a portable hand-held power drill, such drive roller and drive shaft being offset perpendicularly from an associated bearing plate surface a distance sufficient to prevent the motor housing portion of the body of the power drill from contacting the work piece over which the sander is moved.

It is an additional objective of the present invention to provide such a belt-type sander attachment capable of being coupled on either side to a portable hand-held power drill and having a grip knob selectively positionable in alternate locations on either side of the sander opposite its point of coupling with the drill to permit the sander to be readily adjusted for use by a right- or left-handed person.

It is a further objective of the present invention to provide a belt-type sander attachment couplable to a portable hand-held power drill and having a bearing plate for supporting an operative portion of the sanding belt that is sufficiently small in area to prevent a shearing force buildup sufficient to overload the motor of the drill as the sander is pressed against a work surface.

It is a further objective of the invention to provide skids at either end of the sander for preventing gouging of the work piece which might othewise result from the limited size of the bearing plate.

It is a still further objective of the present invention to provide a belt-type sander attachment for a portable power drill that may be removably attached to a work table with the operative portion of its sanding belt oriented in either an upwardly facing horizontal position or in a vertical position.

The foregoing objectives, features and advantages of the present invention will be more readily understood upon consideration of the following detailed description of the invention taken in conjunction with the accompanying drawings.

DETAILED DESCRIPTION OF THE PREFERRED EMBODIMENT

Figure 1:
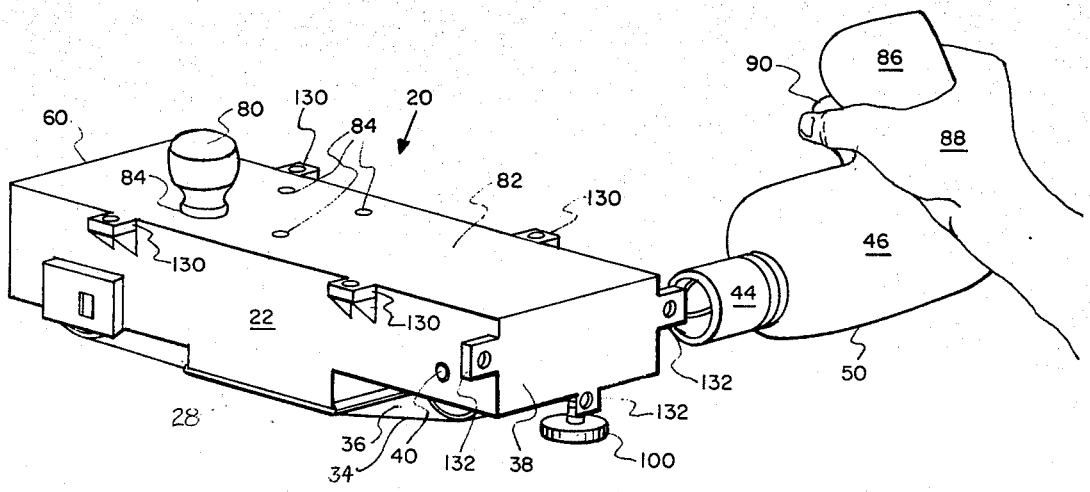
FIG. 1 is a perspective view of the portable belt-type sander attachment of the present invention coupled to a conventional portable power drill for hand-held operation.

As shown in FIGS. 1–5 of the drawings, the preferred embodiment of the sander attachment of the present invention, denoted generally as 20, comprises an elongate body member 22 housing a pair of laterally spaced substantially cylindrical rolles 24 and 26, and including a bearing plate 28 extending across the open bottom 30 of the body member and having a substantially planar bearing surface 32 facing outwardly therefrom. The body member 22 is formed of ABS plastic, or other suitable lightweight substantially rigid shock-resistant material. The two rollers 24 and 26 and the bearing plate 28 are positioned within the body member so as to permit an endless belt 34 of sandpaper to be looped around the rollers with a portion of the inner surface 36 of the sandpaper belt held in contact with the bearing surface 32 of the plate.

Figure 4:
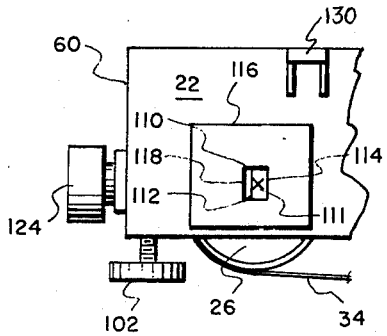
FIG. 4 is a partial side view of the far side of the sander attachment of FIG. 2.
Figure 5:
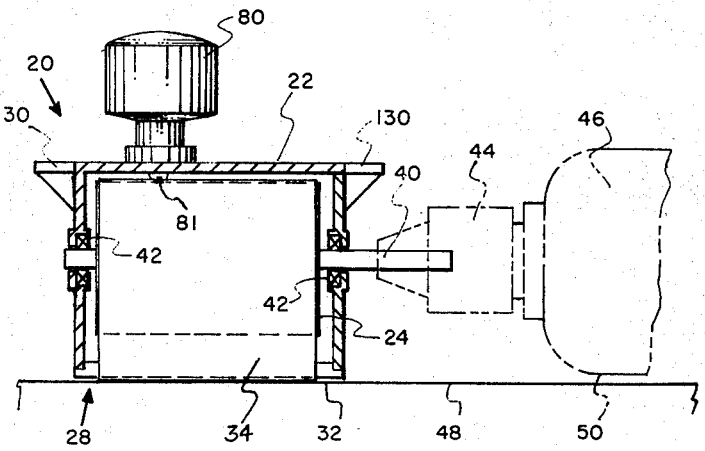
FIG. 5 is a sectional view of the sander attachment taken along line 5—5 of FIG. 2 with certain background parts removed for clarity.

As shown most clearly in FIGS. 4 and 5, the first roller 24, located proximate one end 38 of the body member 22 and serving as the drive roller of the sander, is fixed to a drive axle 40 that is rotatably journaled to the body member 22 by bearings 42 or other suitable means and extends outwardly from a side of a body member a distance sufficient to permit its engagement by the chuck 44 of a conventional portable hand-held power drill 46. The bottom of the roller 24 and the drive axle 40 are offset upwardly from the bearing surface 32 of the bearing plate 28 a distance perpendicular to the plane of the bearing surface sufficient to insure that when the drill 46 is coupled to the drive axle 40, the plane 48 of the bearing surface 32 does not intersect the motor housing 50 of the drill. The axle offset distance is preferably at least one inch from the rotational center of the axle to the plane of the bearing surface.

Figure 3:
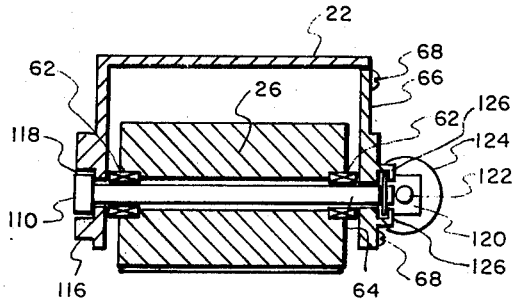
FIG. 3 is a sectional view of the sander attachment taken along line 3—3 of FIG. 2.

The second roller 26, shown in detail in FIG. 3 and located proximate the other end 60 of the body member 22 where it serves as the sander's idler roller, is journaled by bearings 62 or other suitable means to an axle 64 that is mounted in the body member in a manner permitting the roller to rotate freely about the axle. Thus, when the endless sandpaper belt 34 is looped around the two rollers as indicated in the figures, it may be driven across the bearing surface 32 of the bearing plate 28 by rotating the drive roller 24. The outer surface 65 of the drive roller 24 is formed of neoprene or other suitable material to increase the frictional engagement between the roller and the sandpaper belt.

To facilitate installation of the sandpaper belt 34, one side 66 of the body member 22 is removably attached to the remainder of the body member by screws 68 or other suitable fasteners. The axle mount or bearing of a respective axle 64 or 40 simply slides off the axle when the side 66 is removed.

To maintain a desired tautness of the sandpaper belt 34 as the sander is used over an extended period of time, and to accommodate belts of slightly different lengths, provision is made for varying the lateral spacing between the two rollers 24 and 26. As shown in FIGS. 3 and 4, one end of the idler axle 64 rotatably supporting the idler roller 26 is formed in the shape of a rectangular plate 110 that has its major surfaces oriented perpendicularly to the longitudinal axis of the axle. The center of this plate is offset, as shown in FIG. 4, from the axis 11 of the axle 64 such that one edge 112 of the plate is closer to the axle than its opposite edge 114. A housing 116 having a substantially square opening 118 is provided at one side of body member 22 to enclose the edge of the plate 110 such that with the plate 110 oriented in one direction, the lateral spacing between the two rollers 24 and 26 is at a maximum, and with the plate rotated 180°, the spacing between the two rollers is at a minimum.

Figure 2:
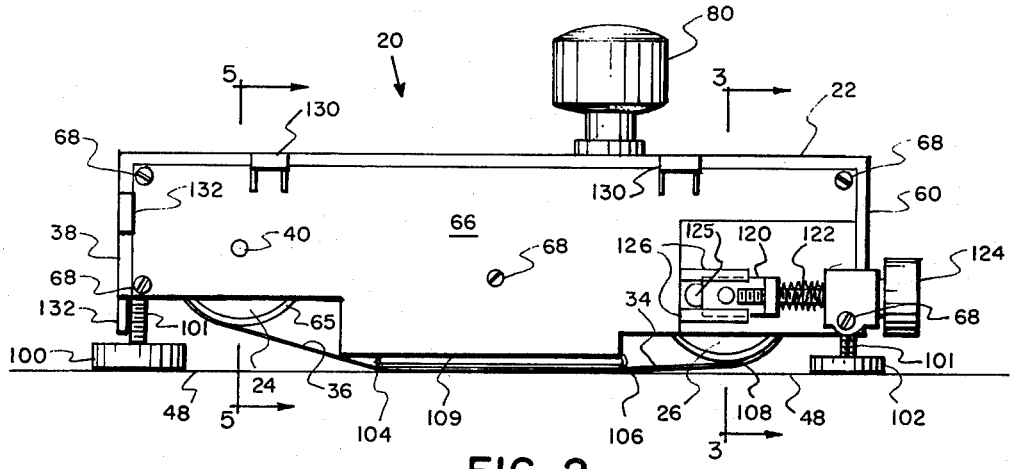
FIG. 2 is a side view of the sander attachment of FIG. 1.

As shown in FIGS. 2 and 3, the end of the idler axle 64 opposite the plate 110 is finely adjustable by means of its connection to an L-shaped member 120 that is coupled by threaded engagement to a rod 122 that is in turn journaled to the body member 22 and rotatable by turning an attached knob 124. The L-shaped member 120 is slidingly retained, proximate a slot 125 formed in the side of the body member 22 through which the end of the axle 64 protrudes, by a pair of elongate channel-like protrusions 126 extending from the side of the body member along either side of the slot. Thus, both ends of the idler 64 axle may be adjusted together to vary the lateral spacing between the two rollers 24 and 26. Furthermore the fine adjustment provided by the knob 124 operates independently to vary the angle between the two rollers. This latter angle adjustment is important to ensure that the sanding belt 34 reamins centered with respect to the two rollers during operation of the sander.

For operation of the sander attachment of the present invention as a hand-held portable sander, the portable drill 46 is coupled to the drive axle 40 extending from the roller 24, as indicated in FIG. 1, and a grip knob 80, adjustably attachable to the top 82 of the body member 22 by a screw 81, is positioned in any of one or more alternate locations 84 on the opposite side of the body member as the drill. The handgrip 86 of the drill 46 is then grapsed by the operator's hand 88 so as to permit manipulation of the drill's on/off switch 90 by the operator's thumb. The handgrip is preferably held either in an upward, forwardly tipped position as shown in FIG. 1 or in a horizontal, rearwardly extending position. With the operator's other hand grasping the grip knob 80 and the drill energized, the sander attachment 20 and coupled drill are then moved across a workpiece with the operative portion of the sanding belt 34, that portion of the belt extending across the bearing surface 32 of the bearing plate 28 at any given moment, in contact with the area of the workpiece to be sanded. When the sander attachment 20 is to be used by a left-handed operator, the drive roller 4 is reversed by removal of the side 66, sliding the roller axially out of its bearings and reinstalling the roller such that its drive axle 40 extends from the opposite side of the body member 22. The screw 81 is then removed and the grip knob 80 is positioned on the respective opposite side of the longitudinal centerline of the body member. With the positions of the drive axle 40 and grip knob 80 thus reversed, the drill 46 may be recoupled to the drive axle and the sander and drill combination operated as before.

The bearing plate 28 providing the backing support for the operative portion of the sanding belt 34 extends in a direction perpendicular to the rotational axes of the two rollers 24 and 26 a distance, preferably not more than 3½inches, which is substantially less than the lateral distance between the two rollers to prevent the shearing forces generated as the sanding belt moves across the surface of the workpiece achieving sufficient magnitude to overload the motor of the drill 46, thereby premitting the sanding belt to be driven at a high linear rate of speed by a relatively low-powered drill. A pair of skids 100 and 102 are adjustably attached by threaded member 101 proximate each end of the body member as shown in FIG. 2 so as to extend from the bottom of the body member a distance sufficient to intersect the plane 48 containing the bearing surface 32. When the sander attachment 20 is operated over a substantially planar workpiece, the two skids 100 and 102 serve to maintain a uniform force distribution between the bearing surface 32 and the surface of the workpiece, thereby preventing any gouging of the workpiece which might otherwise occur at either edge 104 or 106 of the bearing plate 28, or at the line 108 where the sanding belt 34 joins the idler roller 26. A layer of heat-insulative material 109, such as cork, is positioned between the bearing plate 28 and the body member to prevent heat generated by the sanding belt 34 from damaging the plastic material of the body.

Figure 6:
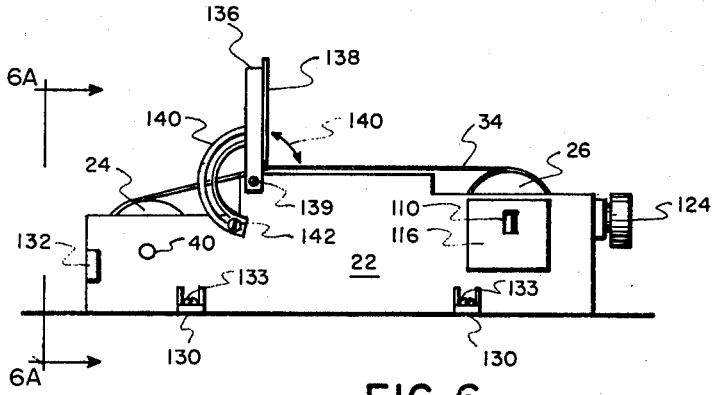
FIG. 6 and 6A are side views of the sander attachment of FIG. 1 mounted on a work table and having the operative portion of its sanding belt oriented in an upwardly facing horizontal position.
Figure 7:
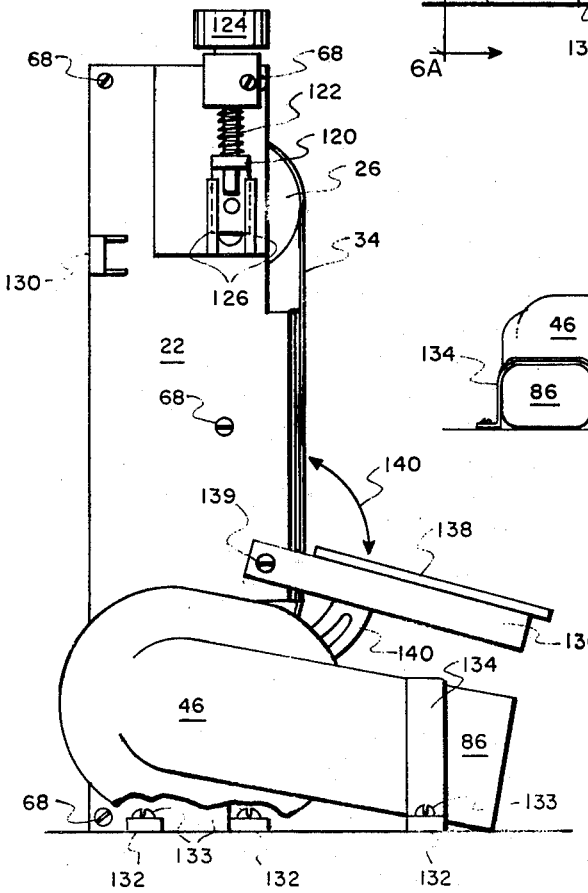
FIG. 7 is a side view of the sander attachment of FIG. 1 mounted on a work table with the operative portion of its sanding belt oriented in a vertical position.
Figure 6A:
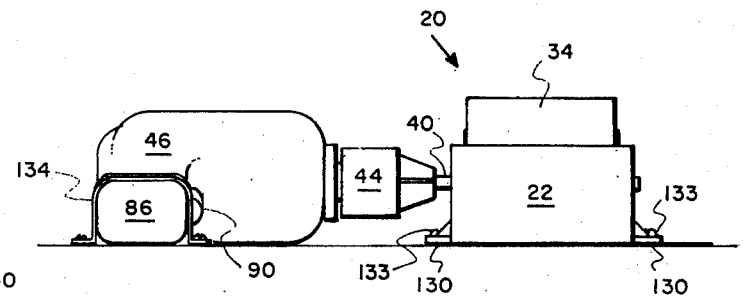

As shown in FIG. 1, a plurality of mounting tabs 130 and 132 extend from the edges of the top and end surfaces of the body member 22 to facilitate its removable attachment to a work table or other work surface with the bearing surface 32 of the bearing plate 28 oriented in either an upwardly facing horizontal position as shown in FIGS. 6 and 6*a* or a vertical position as shown in FIG. 7. Actual attachment of the sander 22 to the work surface is accomplished by screws 133 or other suitable fasteners, with the skids 100, 102 removed. When the sander attachment is mounted on the work surface in either position, the drill 46 coupled to the drive axle 40 of the drive roller 24 rests on the work surface and its handgrip is secured thereto in the position indicated in the figures by a suitable strap 134 attached to the work surface. A guide member 136 having a substantially planar guide surface 138 is hingedly attachable to the body member 22 by screws 139 or other suitable fasterers as shown in FIGS. 6 and 7 to provide an adjustable surface against which a workpice may be held during the operation of the sander. The angle 40 between the guide surface 138 and the bearing surface 32 of the bearing plate 28 may be varied by adjustment of one or more arcuate supports 140 attached to the guide plate 136 and adjustably coupled to the body member 22 by screws 142 or other suitable means to accommodate workpieces of various shapes.

To operate the sander in either the horizontal or vertical position, the operator need merely depress the on/off switch 90 of the drill 46, lock the switch in the depressed position by a locking mechanism usually provided with the drill, and then press the workpiece against the moving sandpaper belt 34.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A portable belt-type sander attachment adapted to be driven by a portable hand-held power drill having a motor-containing housing, a handgrip extending generally perpendicular from said housing and a driving chuck, said sander comprising:

a. an open-bottom body member;

b. first and second substantially cylindrical rollers rotatably mounted in said body member, said rollers being laterally spaced from one another so as to permit an endless sandpaper belt to be looped therearound;

c. said first roller being fixed to drive axle means rotatably journaled in said body member and extending outwardly from a side of said body member for enabling the chuck of said portable hand-held drill to drivingly engage the extending portion thereof such that operation of said drill causes said first roller to rotate;

d. a bearing plate attached to said body member and having a substantially planar bearing surface directed outwardly from the open bottom of said body member, said plate being positioned intermediate said first and second rollers such that when said endless sandpaper belt is looped around said first and second rollers, a portion of the inner surface of said belt is in contact with said surface of said plate;

e. said first roller and said drive axle means being offset from said plate a sufficient distance perpendicular to the plane of said bearing surface such that, when said drill is coupled to said drive axle, the plane of said bearing surface does not intersect said housing of said drill.

2. A portable belt-type sander attachment adapted to be driven by a portable hand-held power drill having a motor-containing housing, a handgrip extending generally perpendicular from said housing and a driving chuck, said sander comprising:

a. an elongate open-bottomed body member;

b. first and second cylindrical rollers rotatably mounted in said body member, said rollers being laterally spaced from one another so as to permit an endless sandpaper belt to be looped therearound, the rotational axes of said rollers being substantially perpendicular to and bisected by a line extending longitudinally through said body member;

c. means for drivingly coupling said portable hand-held power drill selectively to either end of said first roller such that operation of said drill causes said first roller to rotate; and d. handle means adjustably attachable to the top of said body member in alternative positions on either side of said longitudinal line such that when said drill is coupled to either end of said first roller, said handle means may be positioned on the opposite side of said line from said drill.

3. A portable belt-type sander attachment adapted to be driven by a portable hand-held power drill having a motor-containing housing, a handgrip extending generally perpendicular from said housing and a driving chuck, said sander comprising:

a. an open-bottomed body member;

b. first and second substantially cylindrical rollers rotatably mounted in said body member, said rollers being laterally spaced from one another so as to permit an endless sandpaper belt to be looped therearound;

means for drivingly coupling a portable handheld power drill to said first roller such that operation of said drill causes said first roller to rotate;

d. a bearing attached to said body member and having a substantially planar bearing surface directed outwardly from the opening bottom of said body member, said plate being positioned intermediate said first and second rollers such that when said endless sandpaper belt is looped around said first and second rollers a portion of the inner surface of said belt is in contact with said surface of said plate, the dimension of said plate in a direction substantially perpendicular to the rotational axes of said rollers being less than the lateral distance between said rollers; and e. downwardly facing skid means attached to said body member on each side of said bearing plate adjacent each of said rollers and extending from the bottom of said body member a distance sufficient to intersect a plane containing said bearing surface of said bearing plate for maintaining a uniform distribution of force between said bearing surface and a substantially planar workpiece.

4. A portable belt-type sander attachment adapted to be driven by a portable hand-held power drill having a motor-containing housing, a handgrip extending generally perpendicular from said housing and a driving chuck, said sander comprising:

a. an open-bottomed body member;

b. first and second cylindrical rollers rotatably mounted in said body member, said rollers being laterally spaced from one another so as to permit an endless sandpaper belt to be looped therearound;

c. means for drivingly coupling a portable hand-held power drill to said first roller such that operation of said drill causes said first roller to rotate;

d. a bearing plate attached to said body member and having a substantially planar bearing surface directed outwardly from the open bottom of said body member, said plate being positioned intermediate said first and second rollers such that when an endless sandpaper belt is looped around said first and second rollers a portion of the inner surface of said belt is in contact with said surface of said plate; and mounting means attached to said body member for removably attaching said body member to a supportive work surface with said bearing surface of said bearing plate oriented selectively in either of two mutually perpendicular planes.

5. The sander attachment of claim 4 further comprising a guide member having a substantially planar guide surface adapted to be hingedly mounted on said body member with said guide surface extending across said bearing plate parallel to the rotational axes of said rollers, said guide plate including adjustment means for mounting said guide surface in different angular positions relative to said bearing plate.

6. A portable belt-type sander attachment adapted to be driven by a portable hand-held power drill having a motor-containing housing, a handgrip extending generally perpendicular from said housing and a driving chuck, said sander comprising:

a. an open-bottomed body member;

b. first and second substantially cylindrical rollers rotatably mounted in said body member, said rollers being laterally spaced from one another so as to permit an endless sandpaper belt to be looped therearound, said first roller having a drive axle fixed thereto and journaled in said body member so as to permit said first roller to be drivable by driving said axle, and said second roller being journaled on a second axle attached to said body member so as to permit said second roller to rotate freely about said second axle, one end of said second axle forming a rectangular plate member having its major surfaces oriented perpendicular to the longitudinal axis of said second axle and a pair of its opposite edges located at different distances from said axis such that one of said edges is closer to said second axle than the opposite edge;

c. means for drivingly coupling a portable handheld power drill to said drive axle of said first roller such that operation of said drill causes said first roller to rotate d. a bearing plate attached to said body member and having a substantially planar surface directed outwardly from the open bottom thereof, said plate being positioned intermediate said first and second rollers such that when an endless sandpaper belt is looped around said first and second rollers a portion of the inner surface of said belt is in contact with said surface of said plate;

e. means attached to a side of said body member proximate said plate member of said second axle for retaining said plate member in alternate positions with either of said opposite edges oriented in a direction toward said first roller; and f. roller adjustment means attached to said body member proximate the other end of said second axle for adusting the distance between said other end of said second axle and said first roller, whereby the lateral spacing and relative angle between said rollers may be adjusted by selective orientation of said plate member and selective adjustment of said roller adjustment means.

* * * * *

UNITED STATES PATENT AND TRADEMARK OFFICE

CERTIFICATE OF CORRECTION

PATENT NO. : 3,983,664

DATED : October 5, 1976

INVENTOR(S) : Ronald Martin

It is certified that error appears in the above-identified patent and that said Letters Patent are hereby corrected as shown below:

| | | |
|---|---|---|
| Col. 2, | Line 63 | Change "othewise" to --otherwise--. |
| Col. 3, | Line 37 | Change "rolles" to --rollers--. |
| Col. 4, | Line 53 | Change "reamins" to --remains--; |
| | Line 64 | Change "grapsed" to --grasped--. |
| Col. 5, | Line 9 | Change "4" to --24--; |
| | Line 29 | Change "premitting" to --permitting--; |
| | Line 68 | Change "workpice" to --workpiece--. |
| Col. 7, | Line 24 | Add (c) before "means for"; |
| | Line 27 | Add the word "plate" after "bearing"; |
| | Line 29 | Change "opening" to --open--. |

UNITED STATES PATENT OFFICE

CERTIFICATE OF CORRECTION

Patent No. 3,983,664 Dated October 5, 1976

Inventor(s) Ronald Martin Page 2 of 2

It is certified that error appears in the above-identified patent and that said Letters Patent are hereby corrected as shown below:

| | | |
|---|---|---|
| Col. 8, | Line 4 | Add (e) before "mounting"; |
| | Line 44 | Add semi-colon (;) after "rotate"; |
| | Line 60 | Change "adusting" to --adjusting--. |

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*